United States Patent [19]

Geary

[11] Patent Number: 4,935,606

[45] Date of Patent: Jun. 19, 1990

[54] METHOD OF OPERATING GAS FURNACE IGNITER

[75] Inventor: Frederick J. Geary, Holland, Mich.

[73] Assignee: Robertshaw Controls Company, Richmond, Va.

[21] Appl. No.: 284,342

[22] Filed: Dec. 14, 1988

Related U.S. Application Data

[62] Division of Ser. No. 65,360, Jun. 23, 1987, Pat. No. 4,809,128.

[51] Int. Cl.[5] ..... H05B 1/02

[52] U.S. Cl. ..... 219/501; 323/236; 219/492; 219/508; 219/494; 307/84; 307/43; 361/264

[58] Field of Search ..... 219/485, 492, 494, 497, 219/501, 507–509, 480–483; 307/43, 130, 87, 75, 64, 66, 110, 31, 84; 323/319, 235, 236; 361/264

[56] References Cited

U.S. PATENT DOCUMENTS

| | | | |
|---|---|---|---|
| 4,188,528 | 2/1980 | Wierzchowski et al. | 219/492 |
| 4,506,144 | 3/1985 | Hesford et al. | 219/497 |
| 4,604,517 | 8/1986 | Barry | 219/497 |
| 4,608,500 | 8/1986 | Togawa | 307/130 |
| 4,626,697 | 12/1986 | Nelson | 307/43 |
| 4,638,176 | 1/1987 | Martinelli | 307/87 |
| 4,665,323 | 5/1987 | Russell et al. | 307/75 |

*Primary Examiner*—M. H. Paschall

*Attorney, Agent, or Firm*—Candor, Candor & Tassone

[57] ABSTRACT

The combination of a heating element and a control unit therefor and methods of making and of operating the same are provided, the heating element normally being adapted to be operated by the continuous full wave pulses of a certain high voltage alternating current source and the control unit being operatively interconnected to the heating element for operatively interconnecting the heating element to a high voltage alternating current source, the control unit having an arrangement for operating the heating element with a certain repeating pattern of skipped full half-wave pulses of the source when the source has a higher voltage than the certain source.

5 Claims, 1 Drawing Sheet

METHOD OF OPERATING GAS FURNACE IGNITER

CROSS REFERENCE TO RELATED APPLICATION

This application is a divisional patent application of its copending parent application, Ser. No. 065,360, filed June 23, 1987, now Pat. No. 4,809,128.

BACKGROUND OF THE INVENTION

1. Field of the Invention

This invention relates to a new system for operating a heating element means, such as a hot surface igniter for a gas furnace and the like, as well as to new methods of making and operating a heating element means.

2. Prior Art Statement

It is known to provide a combination of a heating element means that is normally adapted to be operated by the continuous full wave pulses of a certain high voltage alternating current source for a predetermined time period so as to provide a desired function thereof and a control means operatively interconnected to the heater means for operatively interconnecting the heater element means and having means to that certain high voltage alternating current source for the predetermined time period so as to provide the desired function thereof. For example, see applicant's copending patent application Ser. No. 887,860, filed July 18, 1986, now Pat. No. 4,711,628.

SUMMARY OF THE INVENTION

It is one feature of this invention to provide a new combination of a heating element means and a control means for interconnecting the heating element means to a high voltage alternating current source in a unique manner.

In particular, it was found according to the teachings of this invention that certain heating element means are each designed to be operated by the continuous full wave pulses of a certain high voltage alternating current source for a predetermined period of time by a control means that is operatively interconnected to the heating element means. However, if such a heating element means is interconnected to a source that has a higher voltage than that certain high voltage alternating current source, such heating element means will be adversely affected by such higher voltage source if the control means operates that heating element means with that higher voltage source for the predetermined time period.

For example, it was found according to the teachings of this invention that a hot surface ignition system for a gas furnace or the like has control means for interconnecting a high voltage alternating current source to the igniter of such system for a predetermined time period so that the igniter will be sufficiently heated, by the continuous full wave pulses of that high voltage alternating current source passing therethrough for that predetermined time period, to ignite gaseous fuel being directed over such igniter. However, such igniter is only adapted to be interconnected to a high voltage alternating current source for such predetermined time period if that high voltage alternating current source only has a voltage of approximately 120 volts because such an igniter will burn out if interconnected even for a shorter time period than the predetermined time period to a high voltage alternating current source that has a higher voltage than 120 volts.

Accordingly, it was found according to the teachings of this invention that a unique control means could be operatively interconnected to the heating element means to permit that heating element means to be interconnected to a high voltage alternating current source that has a higher voltage than the voltage for which that heating element means is rated and will not cause such heating element means to be burned out or be adversely affected even if operated for the predetermined time period that that heating element means was designed to operate with its lower high voltage alternating current source.

In particular, it was found according to the teachings of this invention that the control means of this invention can operate the heating element means with a certain repeating pattern of skipped complete half-wave pulses of a high voltage alternating current source when that source has a higher voltage than the high voltage alternating current source for which that heating element means was designed to be utilized therewith.

For example, one embodiment of this invention provides a combination of a heating element means that is normally adapted to be operated by the continuous full wave pulses of a certain high voltage alternating current source for a predetermined time period so as to provide a desired function thereof, and control means operatively interconnected to the heating element means and having first means for operatively interconnecting the heating element means to that certain high voltage alternating current source for the predetermined time period so as to provide the desired function thereof, the control means having second means for operating the heating element means with a certain repeating pattern of skipped complete half-wave pulses of the another source of high voltage alternating current for the predetermined time period when the source has a higher voltage than the certain source so that the heating element means will not be adversely affected by the other source of higher voltage and will still provide the desired function thereof.

Accordingly, it is an object of this invention to provide a new combination of a heating element means and a control means therefor, the combination of this invention having one or more of the novel features of this invention as set forth above or hereinafter shown or described.

Another object of this invention is to provide a new method of making a combination of a heating element means and a control means therefor, the method of this invention having one or more of the novel features of this invention as set forth above or hereinafter shown or described.

Another object of this invention is to provide a new method of operating a combination of a heating element means and a control means therefor, the method of this invention having one or more of the novel features of this invention as set forth above or hereinafter shown or described.

Other objects, uses and advantages of this invention are apparent from a reading of this description which proceeds with reference to the accompanying drawings forming a part thereof and wherein:

DESCRIPTION OF THE PREFERRED EMBODIMENT

Figure 1:
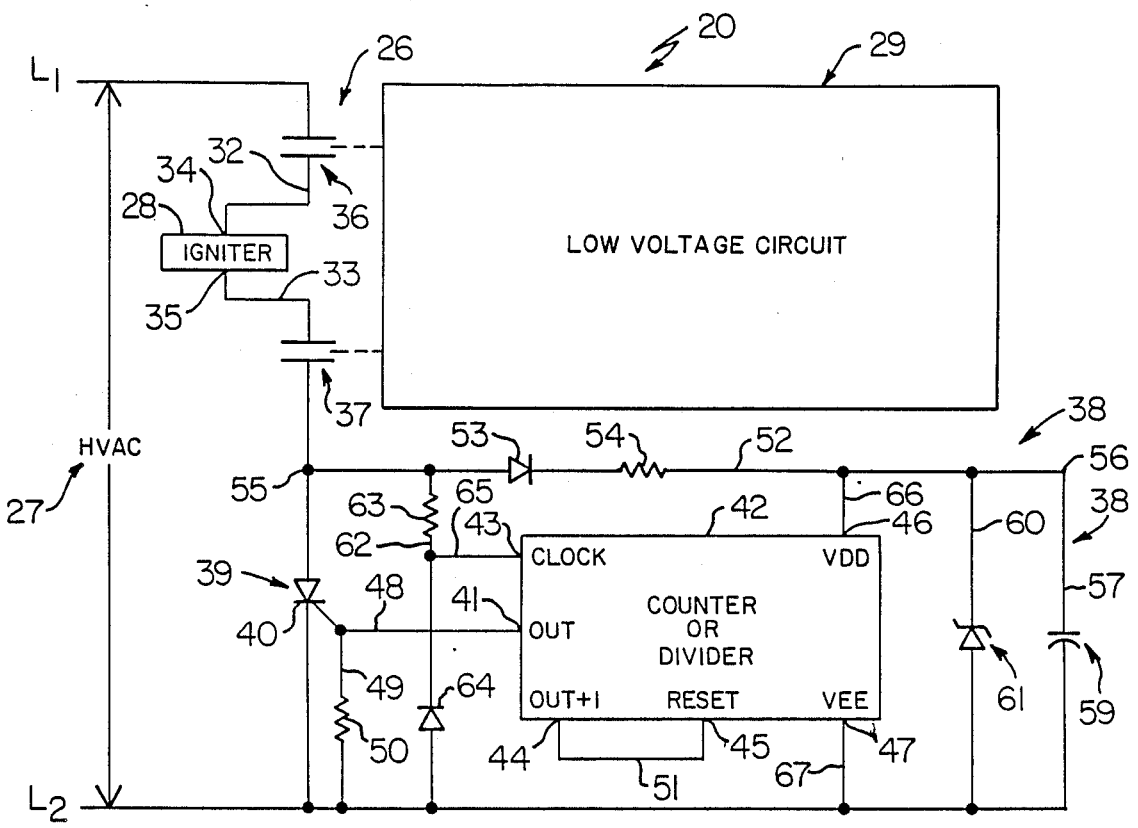
FIG. 1 illustrates the entire wiring circuit of this invention for operating a hot surface ignition system.

While the various features of this invention are hereinafter illustrated and described as being particularly adapted to provide a hot surface ignition system for a gas furnace, it is to be understood that the various features of this invention can be utilized singly or in various combinations thereof to provide a control means for a heating element means that is adapted to provide heat for a purpose other than igniting gas or the like. For example, such a heating element means could be the heating element means of a cooking device, such as the heating element means of a toaster, cooking oven, etc.

Therefore, this invention is not to be limited to only the embodiment illustrated in the drawings, because the drawings are merely utilized to illustrate one of the wide variety of uses of this invention.

Figure 2:
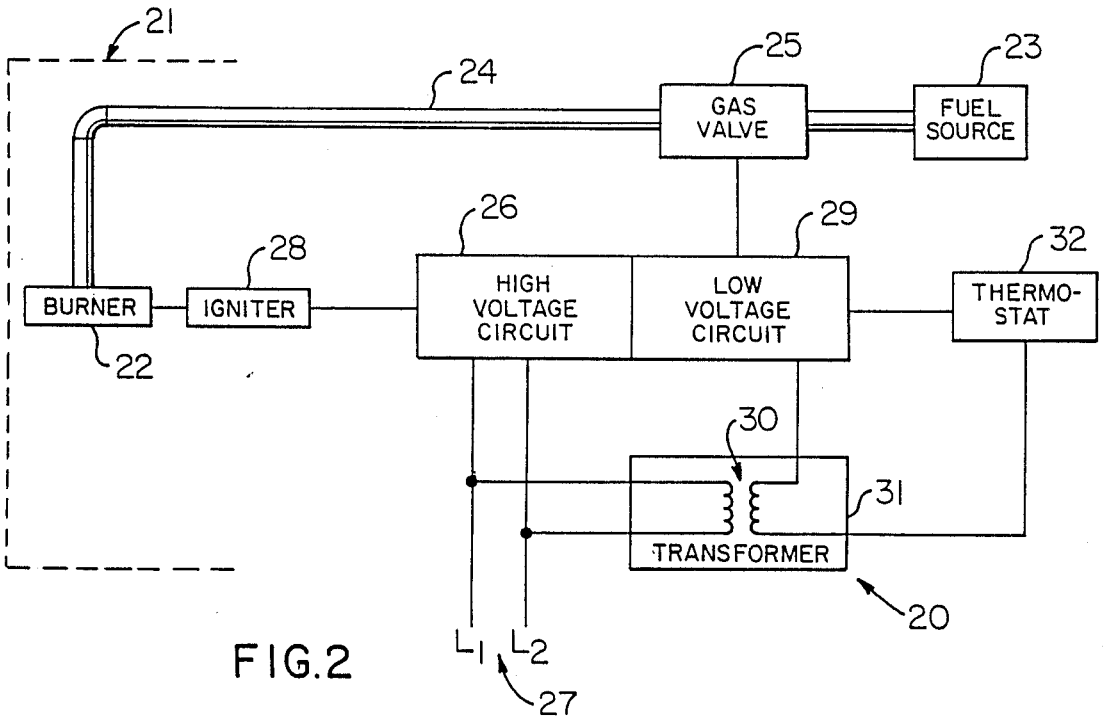
FIG. 2 is a schematic view, mainly in block diagram form, illustrating the hot surface ignition system of FIG. 1.

Referring now to FIG. 2, the new hot surface ignition system of this invention is generally indicated by the reference numeral 20 and is utilized for a gas furnace that is generally indicated by the reference numeral 21 and has a main burner 22 therein that is adapted to be supplied fuel thereto from a fuel source 23 through a conduit means 24 when an electrically operated gas valve 25 is open in a manner hereinafter set forth, the gas valve 25 being part of the hot surface ignition system 20 that further comprises a high voltage circuit or control means 26 being interconnected to a source 27 of high voltage alternating current. The high voltage circuit or control means 26 has a hot surface igniter means 28 therein that is disposed in the path of gas issuing from the burner means 22. The hot surface ignition system 20 also comprises a low voltage circuit or control means 29 for being connected to a source 30 of low voltage alternating current, such as provided by a stepdown transformer 31 in a manner well known in the art, the low voltage circuit or control means 29 having the gas valve 25 therein and having a thermostatic switch means 32 therein for controlling the energization of the low voltage circuit 29 with the source 30 of its low voltage alternating current.

The source 27 of high voltage alternating current comprises the power source leads $L_1$ and $L_2$ as illustrated in FIGS. 1 and 2 and the high voltage circuit 26 of FIG. 1 comprises the igniter 28 and the lead means 32 and 33 that are adapted to respectively interconnect the opposed sides 34 and 35 of the igniter 28 to the leads $L_1$ and $L_2$, the lead means 32 and 33 respectively having normally open contacts 36 and 37 of a relay therein that is operated by the low voltage circuit or control means 29 in the manner fully set forth in the aforementioned copending patent application, Ser. No. 887,860, filed July 18 1986, and now issued by the United States Patent and Trademark Office as Pat. No. 4,711,628 whereby this copending patent application is being incorporated into this disclosure by this reference thereto.

Thus, since the details of the structure and the operation of the control means 26 and 29, except for a part 38 of the high voltage circuit or control means 26 that comprises this invention, is fully set forth in the aforementioned copending patent application, only the details of the new part 38 of the system 20 will now be set forth.

As illustrated in FIG. 1, the new part 38 of the control means 26 comprises a half-wave rectifier 39 or SCR that is disposed in the lead means 33 so as to be in series with the igniter 28 and has a gate 40 that is controlled by an output 41 of a counter or divider 42, the counter 42 having a clock port 43, output plus one port 44, a reset port 45, a VDD port 46 and a VEE port 47.

The output port 41 of the counter is electrically interconnected to the gate 40 of the rectifier 39 by a lead means 48 with the lead means 48 being electrically interconnected to line $L_2$ by a lead means 49 that has a resistor 50 therein. The output plus one port 44 of the counter 42 is electrically interconnected to the reset port 45 by a lead means 51.

A lead means 52 having a diode 53 and resistor 54 in series therein has one end 55 electrically interconnected to the lead means 33 at a point intermediate the relay contact 37 and the rectifier 39 and has another end 56 electrically interconnected to a lead means 57 that has a capacitor 59 therein and is electrically interconnected to the lead means $L_2$.

A lead means 60 having a zener diode 61 therein is electrically interconnected to the lead means 52 and to the lead means $L_2$.

Another lead means 62 is also electrically interconnected to the lead means 52 and the lead means $L_2$, the lead means having a resistor 63 and a diode 64 in series therein.

The clock port 43 of the counter 42 is electrically interconnected by a lead means 65 to the lead means 62 at a point intermediate the resistor 63 and the diode 64. The VDD port 45 of the counter 42 is electrically interconnected by a lead means 66 to the lead means 52 and the VEE port 47 of the counter 42 is electrically interconnected to the lead means $L_2$ by a lead means 67.

Thus, it can be seen that the new part 38 of the control means 26 and 29 of the system 20 is formed of relatively few components adapted to operate in a unique manner hereinafter set forth and while the components of the part 38 of this invention can have any suitable construction and values, one working embodiment thereof that was used with a 120 volt rated Norton igniter No. 201 of the Norton Company, Worcester, Mass., 01606, comprised the counter or chip 42 being a decade counter 4017B, the rectifier 39 being an 8 amp SCR with a 400 volt break-over when the source 27 is approximately 240 volts and being an 8 amp SCR with a 800 volt break-over when the source 27 is approximately 440 volts, the resistor 50 being 1K ohm 0.25w, the resistor 63 being one meg. ohm 0.25w, the diode 64 being 1N4148, the diode 53 being 1N4007, the resistor 54 being 47K ohm 0.25w, the zener diode 61 being an eleven volt 1N6001B, and the capacitor 59 being 0.1 m.f.d./63 volts. However, it is to be understood that the above values and components are not to be a limitation on this invention as the same are merely set forth to illustrate one working embodiment of this invention that operates in the manner now to be described.

In general, the operation of the hot surface ignition system 20 of this invention is that as long as the thermostat 32 is satisfied, the relay means of the control means 29 is in a de-energized condition so that the contacts 36 and 37 thereof are disposed in the open condition as illustrated in FIG. 1 whereby the igniter 28 is disconnected from the high voltage source 27.

However, upon the thermotstat 32 demanding heat from the burner means 22, the thermostat 32 causes the transformer 31 to supply the source 30 of low voltage alternating current to the low voltage control means 29 which will then cause the system 20 to either begin to immediately have the igniter 28 interconnected to the power source 27 by operating the relay means thereof in a nonpurge operation of the system 20 or to have the igniter means 28 interconnected to the high voltage current 27 after a prepurge time period has lapsed, such as after approximately 34 seconds. In any event, the system 20 is adapted to operate the igniter 28 for a certain period of time to heat up the same, such as for a period of 34 seconds, after which the relay means of the control means 29 opens the relay contacts 36 and 37 and the gas valve 25 is operated by the control means 29 to permit fuel to flow from the fuel source 23 to the burner 22 so that the same can issue from the burner 22 and be ignited by the hot surface of the igniter 28 in a manner well known in the art. Should the igniter 28 ignite the gas issuing from the burner 22, the igniter 28 then can act as a flame sensing means for the system 20. However, if the burner means 22 comprises a plurality of burners disposed in side-by-side relation so that the igniter 28 is being utilized to merely ignite one of the burners which in turn then will ignite the next burner and so on until the last burner is ignited, a remote flame sensing means can be utilized.

Once flame sensing has been detected by either the igniter 28 or the remote sense means, such flame sensing means through the control means 29 maintains the gas valve 25 in the open condition thereof to continuously supply fuel to the burner means 22.

However, once the thermostat 32 is again satisfied, the thermostat 32 disconnects the low voltage alternating current source 30 from the low voltage circuit 29 so that the electrically operated gas valve 25 now closes and terminates the flow of fuel from the source 23 to the burner means 22 and the system 20 is now in a condition to again ignite the burner means 22 and operate the same in the manner previously described once the thermostat 32 again demands heat in the manner previously set forth.

Thus, it can be seen that the ignition system of FIGS. 1 and 2 is designed to interconnect the high voltage alternating current 27 to the igniter 28 for approximately 34 seconds each time the thermostat 32 determines that the burner means 22 is to be operated in a manner to supply heat therefrom. However, as previously set forth, the igniter 28 is designed in a manner to be able to withstand the continuous full wave action of the high voltage alternating current source 29 for each 34 second period if the voltage of the source 27 is only approximately 120 volts as applying the continuous full wave action of a high voltage alternating current source of a higher voltage to the igniter for even ten seconds or the like will cause such igniter 28 to completely burn out.

Thus, the purpose of this invention is to use a 120 volt rated igniter 28 at voltages higher than 120 volts, for example, 208 volts, 240 volts, 265 volts, 440 volts and 480 volts. The reason for this is that in many rooftop units employing hot surface igniter, it would be more economical for the manufacturer to use these higher voltages. However, as previously stated the igniter 28 used in the system 20 is limited to 120 volts as an application of a higher voltage would cause the igniter 28 to have a much shorter life and would probably burn out within 15 to 20 seconds. At 120 volts the igniter 28 is left on for 34 seconds and then ignition is attempted. If 240 volts were applied to this igniter 28 it would probably self-destruct long before the 34 seconds was over, probably self-destruct in about 10 to 15 seconds so the method of this invention is to make the igniter 28 think that it is getting the equivalent of 120 volts regardless of what voltage is applied to it. Thus, the principle of this invention is to apply a higher voltage for a shorter time duration since voltage x current x time is really heat. Accordingly, if you increase the voltage and the current and then decrease the time, the equivalency can be reached regardless of what voltage you put on the igniter 28. For example, if 240 volts is placed across the 120 volt device 28, the voltage would go up by a factor of two but the power goes up by a factor of four. Therefore, if one would then put a half-wave/rectifier in series with the igniter 28 with 240 volts at the source 27, one would cut the power in half but this is still twice as much as what was originally started with. But then it was found according to the teachings of this invention that if you put the SCR 39 in series with the igniter 28 at 240 volts and only allowed the SCR 39 to fire every other time, then one would have the equivalency of 120 volts of power in that igniter 28.

Thus, it can be seen that the output 41 of the decade counter chip or divider 42 fires the SCR and then the next pulse after the output resets the counter back to zero so if the counter 42 is set in a manner well known in the art, at the second pulse received by the counter 42 the counter 42 turns the SCR 39 on and then the SCR 39 fires and the counter 42 resets to zero. Accordingly, the SCR would fire every other time so with the 208 volt or 240 volt input of the source 27, the SCR 39 would give the equivalent heat into the igniter 28 of 120 volts. If one went up in voltage say to 440 volts or something like that for the source 27, one could fire the SCR 39 every five pulses or every six pulses and the equivalency that even at 440 volts the igniter 28 is only seeing 120 volts. Thus, the 120 volt igniter 28 can be used with almost any voltage system up to the point where one can divide by ten and it is believed that that is almost 500 volts or more.

As previously stated, without the electronic part 38 of this invention, the system 20 normally applies 120 volts to the igniter 28 when the relay contacts 36 and 37 are closed by the control means 29. The igniter 28 turns on for 34 seconds and at the end of 34 seconds the main valve opens 25 and ignition is attempted. If there is ignition, the igniter 28 is left off and the main valve 25 is left on and the system 20 is working normally. Thus, with all of the electronics 38 shorted out in such system 20, the system 20 is a basic 120 volt system. However, if one wants to operate at a higher voltage, the electronics 38 is placed in series with the relay contacts 36 and 37 as shown. The part 38 comprises counter 42, three resistors 54, 63 and 50, two diodes 53 and 64, one Zener diode 61, one capacitor filter 59 and one SCR 39. When the thermostat 32 is closed, the system 20 goes through its normal cycle and it closes the relay contacts 36 and 37 which are in series with the igniter 28. Of course, the electronics 38 is in series with the relay contacts 36 and 37 so that the circuit 38 is in series whereby the voltage is placed across the SCR 39 which is off at this time. This voltage is also rectified by the diode 53, dropped by the resistor 54 and the Zener diode 61, filtered by the capacitor 59 and applied to the chip, counter or divider 42. Also, going through resistor 63, there is a 60-cycle or 50-cycle clock pulse going into the counter or divider 42 at port 43 which begins to count. If the counter 42 is designed to divide by two, it will count two and there will be an output from the output port 41 which will be directed to the gate 40 of the SCR 39 which, will fire the SCR 39 and cause the SCR 39 to conduct for a complete one-half wave cycle which will put current through the igniter 28. The next pulse will reset the counter 42 by the interconnected ports 44 and 45 and then two more pulses will again trigger the counter 42 so every other pulse from the counter 42 will cause the SCR 39 to fire for the 240 volt application of the system 20.

Going to a higher voltage for the source 27 for the system 20, such as 265 volts or whatever voltage that one would desire to go up to, one would go to a different output port on the counter to the gate 40 of the SCR 39. For instance, one might go to the output port where every fourth pulse would fire the SCR 39 whereby even though the voltage is higher at the time that the current is going through the igniter 28, the time is shorter by a fourth, therefore, one can average the time out so that the igniter 28 always thinks it is getting 120 volts. This is because of using a skip cycle counting where the voltage begins at zero, rises through its sine wave and drops back to zero as it is allowed to go through the igniter 28.

From the above, it can be seen that the resistor 63 is simply a dropping resistor that limits the current into the clock input port 43. The clock input of the counter 42 has diodes built into it to limit the voltage input. The external diode 64 limits the negative swing and is designed to have a DC voltage coming into it. This allows the diode 64 to have AC, and so that diode 64 is just to keep the voltage to less than 6/10ths of a volt on the negative cycle. Resistor 63 limits the actual current that is drawn through the diode 64 and through the chip 42. Diode 53, of course, is nothing more than a rectifier as it changes AC into a pulsating DC. The resistor 54 limits the current through the Zener diode 61 to a small amount and when the Zener diode 61 charges up to its peak voltage, the capacitor 59 is also at that peak voltage and it acts as a filter so that a DC voltage is provided at the port VDD of the counter 42. The port VEE is nothing more than ground.

The resistor 50 goes from the gate 40 of the SCR 39 to ground and is to prevent the SCR 39 from turning on by itself due to leakage currents, etc. The clock 42 is a divide by 10 counter so the output shown feeding the resistor 50 can be anything from 1 to 9. In fact, it can be from 1 to 10 since the particular chip 42 has a reset at the port 45. Thus, whenever you get an output from the counter 42, the next pulse resets the chip 42 back to zero.

Therefore, it can be seen that this invention not only provides a new combination of a heating element means and a control means therefor and method of making the same, but also this invention provides a new method of operating such a new combination.

While the forms and methods of this invention now preferred have been illustrated and described as required by the Patent Statute, it is to be understood that other forms and method steps can be utilized and still fall within the scope of the appended claims wherein each claim sets forth what is believed to be known in each claim prior to this invention in the portion of each claim that is disposed before the terms "the improvement" and sets forth what is believed to be new in each claim according to this invention in the portion of each claim that is disposed after the terms "the improvement" whereby it is believed that each claim sets forth a novel, useful and unobvious invention within the purview of the Patent Statute.

What is claimed is:

1. In the method of operating the combination of a heating element means that comprises a gas igniter for a gas furnace and is normally adapted to be operated by the continuous fill-wave pulses of a first high voltage alternating current source that has a voltage of approximately 120 volts for a predetermined time period so as to provide a certain power output to said heating element means that provides a desired gas ignition function thereof and control means operatively interconnected to said heating element means and having first means for operatively interconnecting said heating element means to said first high voltage alternating current source for said predetermined time period so as to provide said desired gas ignition function thereof, said heating element means being adapted to be destroyed if said heating element means is operated by the continuous fill-wave pulses of a second high voltage alternating current source that has a voltage between approximately 200 volts and approximately 500 volts or higher for said predetermined time period, the improvement comprising the step of using second means of said control means to operate said heating element means with a certain repeating pattern of skipped complete half-wave pulses of said second source of high voltage alternating current for said predetermined time period so that said heating element means will be provided with substantially the same said certain power output from said second source whereby said heating element means will not be adversely affecting by said second source of high voltage and will still provide said desired gas ignition function thereof.

2. A method as set forth in claim 1 wherein said second means skips every other complete half-wave pulse of said second source when said voltage of said second source is between approximately 200 volts and approximately 265 volts.

3. A method as set forth in claim 1, wherein said second means skips four out of every five complete half-wave pulses of said second source when said voltage of said second source is between approximately 400 volts and approximately 480 volts.

4. A method as set forth in claim 1 wherein said second means skips five out of every six complete half-wave pulses of said second source when said voltage of said second source is between approximately 400 volts and approximately 480 volts.

5. A method as set forth in claim 1 wherein said second means comprises a decade counter.

* * * * *

Disclaimer 4,935,606.—*Frederick J. Geary*, Holland, Mich. METHOD OF OPERATING GAS FURNACE IGNITER. Patent dated June 19, 1990. Disclaimer filed April 16, 1990, by the assignee, Robertshaw Controls Co.

The term of this patent subsequent to February 28, 2006, has been disclaimed.

[*Official Gazette September 25, 1990* ]